US009427049B2

(12) United States Patent
Shelton

(10) Patent No.: US 9,427,049 B2
(45) Date of Patent: Aug. 30, 2016

(54) INSTANT CONTROL SYSTEM USING A FIXED STUD LATCHING SYSTEM

(71) Applicant: World's Best Halter, Inc., West Frankfort, IL (US)

(72) Inventor: Danny Shelton, West Frankfort, IL (US)

(73) Assignee: World's Best Halter, Inc., West Frankfort, IL (US)

( * ) Notice: Subject to any disclaimer, the term of this patent is extended or adjusted under 35 U.S.C. 154(b) by 207 days.

(21) Appl. No.: 14/156,355

(22) Filed: Jan. 15, 2014

(65) Prior Publication Data

US 2014/0215979 A1 Aug. 7, 2014

Related U.S. Application Data

(60) Provisional application No. 61/752,640, filed on Jan. 15, 2013.

(51) Int. Cl.

| | |
|---|---|
| ***B68B 1/02*** | (2006.01) |
| ***B68B 1/04*** | (2006.01) |
| ***A44B 11/22*** | (2006.01) |

(52) U.S. Cl.

CPC ..... *A44B 11/22* (2013.01); *B68B 1/02* (2013.01); *B68B 1/04* (2013.01); *Y10T 24/406* (2015.01)

(58) Field of Classification Search

CPC ..... B68B 1/02; B68B 1/04; Y10T 24/406; Y10T 24/4026; Y10T 24/4033; A44B 11/22

USPC ..... 54/85, 6.2, 42.1, 69, 59, 28, 21, 64, 24, 54/6.1

See application file for complete search history.

(56) References Cited

U.S. PATENT DOCUMENTS

| | | | | |
|---|---|---|---|---|
| 143,284 A * | 9/1873 | Hartzell | A44B 11/22 | 24/174 |
| 252,500 A * | 1/1882 | Nelson | B68B 1/02 | 54/85 |
| 350,778 A * | 10/1886 | Simons | A44B 11/22 | 24/174 |

(Continued)

*Primary Examiner* — Son T Nguyen

(74) *Attorney, Agent, or Firm* — Mark A. Pitchford; Waller Lansden Dortch & Davis

(57) ABSTRACT

A latching system is operable to prevent inadvertent total release of two straps secured by the latching system as the two straps are being latched together. The latching system includes a buckle affixed to an end of a first strap and a plurality of fixed studs affixed to a second strap to be secured to the first strap. The plurality of fixed studs successively latch with the buckle as the second strap is pulled through a first section of the buckle. One of the fixed studs will catch in the buckle even if the first strap is pulled away from the second strap before latching is completed. Latching is completed by passing the second strap through a second portion of the buckle. In one embodiment, when latching is complete, two fixed studs engage the buckle to secure the second strap to the first strap.

7 Claims, 2 Drawing Sheets

(56) References Cited

U.S. PATENT DOCUMENTS 505,473 A * 9/1893 Mehring ..... A44B 11/22 24/174
712,363 A * 10/1902 Dattlebaum ..... A41B 3/08 2/134
879,465 A * 2/1908 Holmes ..... A44B 11/04 24/186
1,034,681 A * 8/1912 Bliss ..... A44B 11/22 24/163 R
1,126,205 A * 1/1915 Hartmann ..... A44B 11/2526 24/186
1,525,676 A * 2/1925 Warnes ..... B68B 1/02 54/24
1,543,399 A * 6/1925 Smith ..... A44C 5/2071 2/322
2,262,269 A * 11/1941 Cooper ..... A44B 11/25 24/163 R
3,088,184 A * 5/1963 Bittner ..... A43C 11/14 24/175
3,096,552 A * 7/1963 Kreger, Jr. ..... B38C 1/16 24/166
3,805,334 A * 4/1974 Graup ..... A43C 11/1413 24/173
3,967,391 A * 7/1976 Kastinger ..... A43C 1/1406 24/70 SK
4,233,712 A * 11/1980 Horst ..... A44B 11/226 24/166
4,413,465 A * 11/1983 Blevins ..... B68C 1/16 24/164
4,470,174 A * 9/1984 Rhea ..... A41F 9/002 24/16 PB
4,852,336 A 8/1989 Gammill
5,189,763 A * 3/1993 Voumard ..... A44B 11/22 24/163 R
5,615,539 A 4/1997 Graham
5,774,957 A * 7/1998 Kohl ..... A44C 5/2057 24/616
2002/0148207 A1 10/2002 Cook
2006/0156698 A1 7/2006 Barnes
2007/0089380 A1 4/2007 Bechtold
2007/0107169 A1* 5/2007 Kung ..... A44B 11/2573 24/308
2012/0222270 A1* 9/2012 Schultz ..... A44B 11/22 24/303
2013/0213319 A1* 8/2013 Hoffman ..... A01K 27/002 119/792
2015/0150341 A1* 6/2015 Singh ..... A44B 11/006 24/303

* cited by examiner

INSTANT CONTROL SYSTEM USING A FIXED STUD LATCHING SYSTEM

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims priority to and hereby incorporates by reference in its entirety U.S. Provisional Patent Application Ser. No. 61/752,640 entitled "INSTANT CONTROL SYSTEM USING A FIXED STUD LATCHING SYSTEM" filed on Jan. 15, 2013.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to systems for releasably securing two straps to one another. More particularly, the invention pertains to a buckle or latching systems for use in belts, straps, or harnesses.

Halters or bridles for animals (e.g., halters or bridles for horses) typically use a standard buckle to interlock with a selected hole of a plurality of holes in a strap of the bridle. The buckle has a post and a frame including a divider which creates two holes in the frame, a first section and a second section. The post is secured to the divider (e.g., an end portion of the post is bent around the divider). The strap is threaded through the first section of the buckle, the post is fitted through the selected hole in the strap, and the strap is threaded on through the second section of the buckle. The post then catches on the frame as the strap is pulled back through the first section, preventing the strap from pulling out of the buckle. If an animal (e.g., a horse) pulls away while the halter or bridle is being attached to the animal, the post will not automatically catch or fit through any of the holes in the strap, and the strap will pull completely out of the buckle (i.e., out of the first section of the buckle). The animal is then completely untethered and, especially in the case of a horse, may try to get away from the handler by moving toward and past (e.g., jumping over) the handler. This frequently results in injuries to people attempting to place a halter/bridle on an animal and to the animal being haltered or bridled. Similar situations occur when, for example, securing a boat to a dock or trailer and waves move the boat.

BRIEF SUMMARY OF THE INVENTION

Aspects of the present invention provide a latching system operable to prevent inadvertent total release of two straps being latched together by the latching system. The latching system includes a buckle affixed to an end of a first strap and a plurality of fixed studs affixed to a second strap to be secured to the first strap. The plurality of fixed studs successively latch with the buckle as the second strap is pulled through a first section of the buckle. One of the fixed studs will catch in the buckle even if the first strap is pulled away from the second strap before latching is completed. Latching is completed by passing the second strap through a second portion of the buckle. In one embodiment, when latching is complete, two fixed studs engage the buckle to secure the second strap to the first strap.

In one aspect, a control latching system operable to latch one strap to another strap includes a buckle and a stud. The buckle is affixed to an end of a first strap, and the buckle includes a top surface, a pair of protrusions, and a pin. The top surface has a notch. The pair of protrusions extend out of the plane of the top surface. The pin extends between the pair of protrusions, and the pin secures the buckle to an end of the first strap. The stud is affixed to a second strap at a predetermined distance from the end of the second strap. The notch in the top surface of the buckle is operable to engage the stud when the second strap is pulled through the buckle and maintain a spatial relationship between the first strap and the second strap. It is contemplated that the first strap and the second strap may be opposing ends of the same strap.

In another aspect, a control latching system operable to latch a first strap to a second strap includes a buckle and a stud. The buckle is operable to affix to an end of the $1^{st}$ strap. The buckle includes a top surface, a pair of protrusions, and a pin. The top surface has a notch and generally defines a plane. The pair of protrusions extend out of the plane defined by the top surface. The pin extends between the pair of protrusions. The pin is operable to secure the end of the first strap to the buckle. The stud is operable to affix to the second strap at a distance from an end of the $2^{nd}$ strap. In one embodiment, the distance is greater than a length of the buckle. The notch in the top surface of the buckle is operable to engage the stud when the buckle is affixed to the end of the first strap, the stud is affixed to the second strap, and the second strap is positioned between the pin and the top surface of the buckle.

In another aspect, headgear for an animal includes a first strap, a second strap, and a latching system. The latching system is operable to latch the first strap to the second strap. The latching system includes a buckle and a stud. The buckle is affixed the first strap at an end of the first strap. The buckle includes a top surface having a notch, a pair of protrusions, and a pen. The top surface generally defines a plane. The pair of protrusions extend out of the plane defined by the top surface. The pin extends between the pair of protrusions, and the end of the first strap is secured to the pin. The stud is affixed to the second strap at a distance from an end of the second strap. The notch in the top surface of the buckle is operable to engage the stud when the second strap is positioned between the pin and the top surface of the buckle.

In another aspect, a buckle of a latching system operable to latch a first strap to a second strap includes a top surface having a notch, a pair of protrusions, and a pen. The top surface generally defines a plane. The pair of protrusions extend out of a plane defined by the top surface. The pin extends between the pair of protrusions, and hit is operable to secure the end of the first strap to the buckle.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 3:
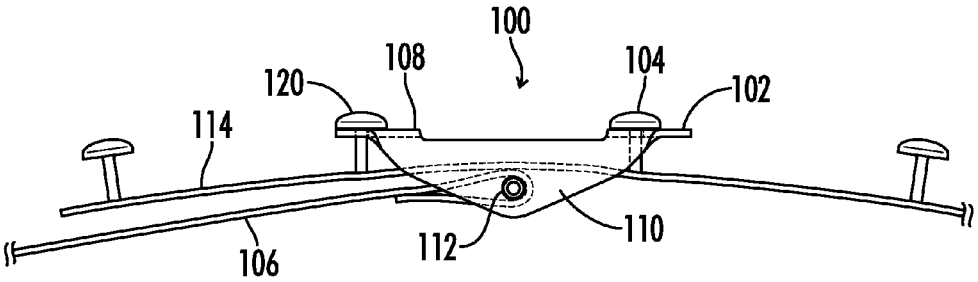
FIG. 3 is a side perspective view of a control latching system securing or latching two straps together.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. Referring to FIG. 3, an upright position of a latching system 100 is defined with respect to a plane or top surface 108 of a buckle 102 being in a generally horizontal orientation with a pin 112 of the buckle being below the plane or top surface 108 of the buckle 102.

Figure 1:
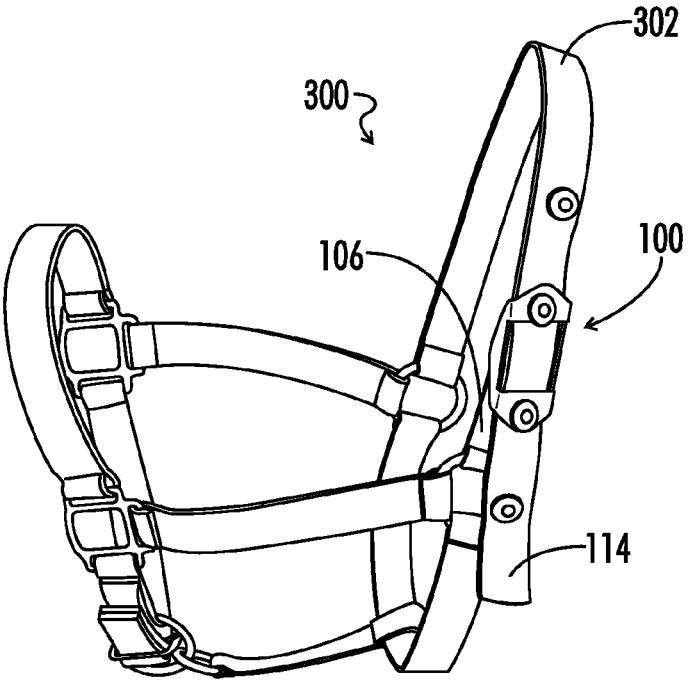
FIG. 1 is an isometric view of headgear for an animal including a latching system.
Figure 2:
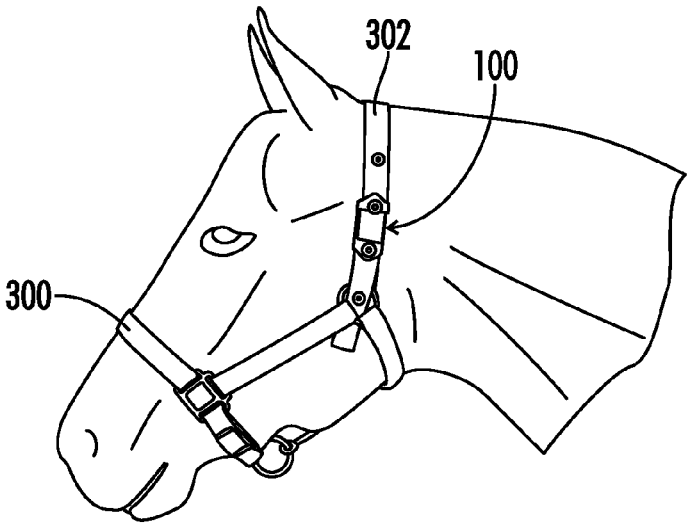
FIG. 2 is a side perspective view of a horse halter including a latching system.

Referring to FIGS. 1-2, headgear 300 for an animal includes a latching system 100. In one embodiment, the headgear 300 is a halter for a horse. It is also contemplated that the headgear 300 may be a bridle, headstall, or other headgear for a horse, or some other animal such as a donkey or elephant. In the embodiment shown in FIGS. 1 and 2, the latching system 100 is incorporated into a crown piece 302 of the halter 300. The latching system 100 secures a first strap 106 of the crown piece 302 to a second strap 114 of the crown piece 302 to secure the halter 300 about the horse's head.

Referring more specifically to FIGS. 3-7, the control latching system 100 may be used in a variety of applications to secure one strap to another strap such as a belt, saddle, load retaining strap, etc. The control latching system 100 includes a buckle 102 and a stud 104. The buckle 102 is operable to affix to an end of the first strap 106. The buckle 102 includes a top surface 108 having a notch 202 (see FIG. 4). A pair of protrusions 110 extend out of a plane 306 generally defined by the top surface 108. In one embodiment, the pair of protrusions 110 extend substantially perpendicularly from the plane 306 defined by the top surface 108. A pin 112 of the buckle 102 extends between the pair of protrusions 110 and secures the buckle 102 to the end of the first strap 106. In one embodiment, the pin 112 secures to the end of the first strap 106 by passing through a loop in the first strap 106 at the end of the first strap 106. In one embodiment, the pin 112 is removable. For example, the pin 112 may be threaded into holes in the pair of protrusions 110, or the pin 112 may be a bolt passing through holes in the pair of protrusions 110 utilizing a lock nut or thread locking compound. In another embodiment, the pin 112 is press fit into the holes in the protrusions 110.

The stud 104 is operable to affix to the second strap 114 at a predetermined distance from an end of the second strap 114. The notch 202 in the top surface 108 of the buckle 102 is operable to engage the stud 104 when the second strap 114 is pulled through the buckle 102 such that the second strap 114 is positioned between the pin 112 and the top surface 108 of the buckle 102 with the stud 104 facing away from the pin 112. The stud 104 and buckle 102 cooperate to maintain a spatial relationship between the first strap 106 and the second strap 114. That is, the stud 104 is received into the notch 202 which prevents longitudinal movement of the first strap 106 relative to the second strap 114. In one embodiment, the stud 104 protrudes substantially perpendicularly from the second strap 114. It is contemplated that the stud 104 may not be precisely perpendicular due to flexibility of the second strap 114 or misalignment of the stud 104. In one embodiment, the stud 104 is affixed to the second strap 114 by screwing a washer and machine screw, bolt with enlarged head, or machine screw with enlarged head through the second strap 114 and into the bottom of the stud 104. In another embodiment, the stud 104 is riveted to the second strap 114. It is contemplated that the post 104 may be affixed to the second strap 114 by a variety of other schemes without deviating from the scope of this disclosure.

Figure 4:
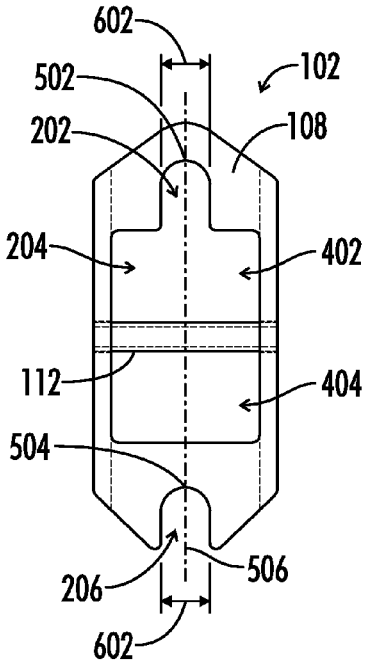
FIG. 4 is a top perspective view of a buckle of the control latching system of FIG. 3.
Figure 5:
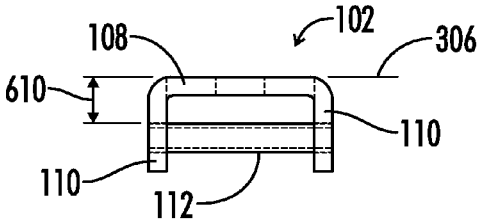
FIG. 5 is a front perspective view of the buckle of FIG. 4.

Referring to FIGS. 4 and 5, the top surface 108 of the buckle 102 has an opening 204. The pin 112 is substantially centered with respect to the opening 204 in the top surface 108 of the buckle 102 defining a first section 402 of the opening 204 and a second section 404 of the opening 204. Passing the second strap 114 up through the first section 402 of the opening causes the stud 104 to engage the notch 202 if the second strap 114 is suddenly pulled back through the first section 402 of the opening 204. Extending the second strap 114 over the pin 112 causes the stud 104 to at least partially extend up through the opening 204. That is, the distance 610 between a top of the pin 112 and the top surface 108 of the buckle 102 is less than a height of a post 302 of the stud 104. In one embodiment, the notch 202 in the top surface 108 of the buckle 102 is integral with the opening 204. In one embodiment, the top surface 108 of the buckle 102 has a second notch 206, and the second notch 206 is not integral with the opening 204. In one embodiment, the notch 202 and second notch 206 are substantially U shaped having a center at a back of the U. A center 502 of the notch 202 is aligned with a center 504 of the second notch 206 along a longitudinal axis 506 of the buckle 102. In one embodiment, the longitudinal axis 506 is substantially centered with respect to the top surface 108 of the buckle 102. As shown in FIG. 3, the second notch 206 is operable to engage a second stud 120 on the second strap 114. In one embodiment, the stud 104 is one of a plurality of studs centered along a length of the second strap 114, and a distance between each stud of the plurality of studs on the second strap 114 is substantially equal to the distance between the center 502 of the first notch 202 and the center 504 of the second notch 206.

Figure 6:
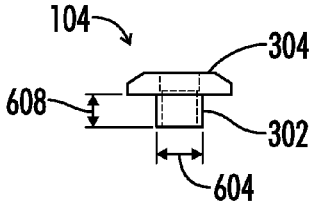
FIG. 6 is a side perspective view of a stud of the control latching system of FIG. 3.
Figure 7:
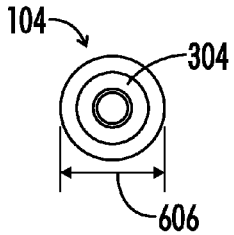
FIG. 7 is a top perspective view of the stud of FIG. 6.

Referring to FIGS. 6 and 7, the stud 104 includes a post 302 and a cap 304. The post 302 extends substantially perpendicularly from the second strap 114, and the cap 304 protrudes substantially perpendicularly from the post 302 such that the 304 is generally parallel to the second strap 114. In one embodiment, the post 302 has a height 608 that is greater than a distance 610 by which the pin is offset from the top surface 108 of the buckle 102. The notch 202 in the top surface 108 of the buckle 102 is sized to accept the post 302 of the stud 104. That is, the notch 202 in the top surface 108 of the buckle 102 has a dimension 602 that is larger than a corresponding dimension 604 of the post 302 and smaller than a corresponding dimension 606 of the cap 304 such that the cap 304 catches on the top surface 108 of the buckle 102 as the second strap 114 is pulled away from the first strap 106 if a user does not push the cap 304 of the stud 104 toward the pin 112 and through the opening 204 in the top surface 108 of the buckle 102. Thus, the latching system 100 automatically latches when the two straps are pulled tight together and requires intentional action to unlatch whereas in the prior art, a buckle requires further intentional action (i.e., pushing a post of the buckle through a hole in the second strap) to latch while the two straps are pulled tight together and will automatically release until that intentional action is completed.

It is contemplated that the control latching system disclosed herein may be used with, for example, belts, halters, bridles (e.g., horse halters, bridles), messenger bag straps, or any other application where one strap is secured to another strap. It is also contemplated that the first strap 106 and second strap 114 may be opposing ends of the same strap.

In one embodiment of the horse halter 300, the buckle 102 is cut or stamped from 12 gauge mild steel or 304 stainless steel and bent to form the protrusions such that the protrusions are integral with the top surface 108. The holes for the pin 112 may be stamped or cut, or drilled after the buckle 102 is bent to form the protrusions. In one embodiment, a width and length of the opening 204 is 0.875 inches, with the notch 202 adding 0.3 inches to the length. Similarly, the second notch 206 has a length of 0.3 inches. A dimension 602 of the notch 202 and second notch 206 is 0.3 inches. The distance from a center of the pin 112 to the top surface is 0.567 inches. An overall length of the buckle 102 is 2.22 inches. A height 608 of the post 302 is 0.25 inches. The width 604 of the post 302 is 0.25 inches. The cap 304 has a width 606 of 0.625 inches.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful INSTANT CONTROL SYSTEM USING A FIXED STUD LATCHING SYSTEM it is not intended that such references be construed as limitations upon the scope of this invention except as set forth in the following claims.

What is claimed is:

1. Headgear for an animal comprising:

a first strap;

a second strap;

a latching system operable to latch the first strap to the second strap, said latching system comprising:

a buckle affixed to the first strap at an end of the first strap, the buckle comprising:

a top surface having a notch, wherein the top surface generally defines a plane;

a pair of protrusions extending out of the plane defined by the top surface; and a pin extending between the pair of protrusions, wherein the end of the first strap is secured to the pin; and a stud affixed to the second strap at a distance from an end of the second strap, wherein the notch in the top surface of the buckle is operable to engage the stud when the second strap is positioned between the pin and the top surface of the buckle, wherein:

the top surface of the buckle has an opening;

the pin is substantially centered with respect to the opening in the top surface;

the notch in the top surface of the buckle is a first notch and is integral with the opening;

the top surface of the buckle has a second notch;

the second notch is not integral with the opening;

the latching system further comprises a plurality of studs affixed to the second strap;

the stud is one of the plurality of studs affixed to the second strap; and a distance between each stud of the plurality of studs affixed to the second strap is substantially equal to a distance between a center of the first notch and a center of the second notch.

2. The headgear of claim 1, wherein:

the stud comprises a post and a cap, said post having a height;

the pin is offset from the plane defined by the top surface of the buckle by a distance no more than the height of the post of the stud.

3. The headgear of claim 1, wherein:

the stud protrudes substantially perpendicularly from the second strap and away from the pin when the second strap is positioned between the pin and the top surface of the buckle.

4. The headgear of claim 1, wherein:

the stud comprises a post and a cap;

the post extends substantially perpendicularly from the second strap; and the cap protrudes substantially perpendicularly from the post such that the cap is generally parallel to the second strap.

5. The headgear of claim 1, wherein:

the stud comprises a post and a cap;

the post extends substantially perpendicularly from the second strap;

the cap protrudes substantially perpendicularly from the post such that the cap is generally parallel to the second strap;

the notch in the top surface of the buckle has a dimension larger than a corresponding dimension of the post of the stud; and the dimension of the notch in the top surface of the buckle is smaller than a corresponding dimension of the cap of the stud.

6. The headgear of claim 1, wherein:

the buckle has a longitudinal axis extending through the center of the first notch and the center of the second notch, wherein the longitudinal axis is substantially centered with respect to the top surface of the buckle.

7. The headgear of claim 1, wherein the headgear is a horse halter or horse bridle.

* * * * *